United States Patent [19]

Cruz

[11] Patent Number: 4,776,254

[45] Date of Patent: Oct. 11, 1988

[54] DAMPER ASSEMBLY FOR A CYMBAL

[76] Inventor: Julio Cruz, 4359 NW. 11th St., Apartment 1E, Miami, Fla. 33126

[21] Appl. No.: 144,196

[22] Filed: Jan. 13, 1988

[51] Int. Cl.[4] ..... G10D 13/06

[52] U.S. Cl. ..... 84/422 R; 84/411 M

[58] Field of Search ..... 84/402 A, 411 M, 421, 84/422 C, 422 H

[56] References Cited

U.S. PATENT DOCUMENTS 922,706 5/1909 Ludwig ..... 84/422 C 1,092,276 4/1914 Ludwig ..... 84/422 C 4,216,696 8/1980 Alexis ..... 84/422 H

*Primary Examiner*—Lawrence R. Franklin

*Attorney, Agent, or Firm*—John Cyril Malloy

[57] ABSTRACT

A damper or muffler assembly for a cymbal of the type used in combination with a set of drums and played by striking repeatedly the cymbal with a drumstick. The assembly comprises a plurality of switch mechanisms manually and automatically operable to position a clamping assembly into operative and clamping position relative to the cymbal so as to render it immovable, when clamped, thereby dampening the sound issuing therefrom.

14 Claims, 1 Drawing Sheet

DAMPER ASSEMBLY FOR A CYMBAL

BACKGROUND OF THE INVENTION

1. Field of the Invention

This invention relates to a damper assembly of the type used to dampen or muffle the sound issuing from a cymbal when it is struck with a drumstick or like instrument in the normal fashion wherein a vibration and movement of the cymbal is stopped, by a clamping assembly thereby serving to dampen the sound issuing therefrom.

2. Description of the Prior Art

In the playing of percussion instruments, more specifically a drum set, the use of outstanding cymbals is quite common. The cymbals, of course, are played similar to the drums in that they are struck repeatedly by a drumstick or like instrument specifically designed to render from the cymbals, when struck, certain sounds. In certain situations, it is more desirable from a musician's stand-point to effectively muffle or dampen the sound issuing from the cymbal. Typically, in the prior art, this is accomplished by stopping the vibrational movement of the cymbal either by the hand of the player or alternately by some type of mechanical, electrical or like manipulative device serving to engage the moving cymbal and absorb the vibration therefrom.

The Peterson U.S. Pat. No. 3,688,627 discloses an electrically operated rhythm instrument which includes an electronically controlled damper which engages but does not physically grip a cymbal thereby dampening the vibration and the attendant sound issuing therefrom. It should be noted that the dampener structure associated with this device is totally electronically controlled and in effect is part of an organ mechanism.

The Rowe U.S. Pat. No. 2,484,745 is directed to a damper operating mechanism for electric percussion instruments designed for use with an instrument including a plurality of horizontally arranged resonant bars of graduated dimension in order to obtain the desired tone when the bar is struck by a striker. A dampener structure is associated therewith.

Other related prior art devices are demonstrated in the following U.S. patents: Lee, U.S. Pat. No. 4,667,562; Miessner, U.S. Pat. No. 1,979,633; Kennedy et al., U.S. Pat. No. 3,009,438; Kondoh, U.S. Pat. No. 4,619,178; Londe, U.S. Pat. No. 3,167,995; Hughes, U.S. Pat. No. 2,765,696; Side, U.S. Pat. No. 2,587,236.

Accordingly, while the above set forth patents and the general knowledge of the prior art demonstrates that dampening cymbals to accomplish certain sounds by mechanical and electrical means is generally known in the art, none of the devices represented in the aforementioned patents or known by the inventor herein relate to a specific device which automatically serves to clamp the cymbal into a relatively immovable position through the use of a clamp assembly wherein a clamp assembly and positioning means are activated by manually and automatic operable switches in an efficient manner without the need for complicated electronic circuitry or hardware equipment to accomplish the above.

SUMMARY OF THE INVENTION

The present invention relates to a damper assembly of the type mounted adjacent and in operative relation to an up-standing cymbal. The cymbal in question may take a variety of forms and the subject damper assembly of the present invention may be used with any number of a variety of type of cymbal structures. Typically, the cymbal is an outstanding cymbal of the type used with a drum set and which is "played" by being struck repeatedly with a drumstick or other applicable, conventional instrument.

The damper assembly of the present invention includes a clamp assembly supported by a plurality of interconnected linkage members or arms specifically structured and disposed to allow movement of the clamp assembly into an operative position relative to the cymbal and outwardly therefrom into a non-operative position. The movement of the clamp assembly is accomplished by a positioning means connected to the linkage in a manner which tends to move at least a portion thereof and accordingly the supported and attached clamp assembly. The positioning means preferably is in the form of a reversible drive motor electronically powered from a conventional electrical power source and activated by a first switch means. The switch means is disposed in the general vicinity of the player or user of the cymbal and may take a variety of forms. More specifically, the first switch means may include a switching mechanism or device which may be hand operable, foot operable or may even include a contact switch which may be operated by striking the contact switch with a drumstick or like instrument used to also strike the cymbal.

In any event, manipulation or striking of the first switch means serves to activate the drive motor of the positioning means so as to position the aforementioned clamp assembly between the aforementioned operative position and non-operative position.

The clamp assembly itself preferably comprises two clamp members substantially opposed and connected to an activating means. The activating means itself may comprise a solenoid or any other applicable readily commercially available and well known structure which allows for the movement of at least one of the clamp members relative to the other and into engaging clamping relation with opposite sides of the cymbal. Accordingly, it should be readily apparent that the clamp members upon activation of a second switch means will be brought into a clamped position from a non-clamped position. The clamp position, as set forth above, is defined by both of the clamp members engaging in opposite surface or side of the cymbal, concurrently, such that the cymbal is clamped, relatively immovably, therebetween. In such a position, the vibration of the cymbal is of course dampened and the attendant sound issuing therefrom is, of course, muffled. The clamping means preferably has an adjustable delay control switch to cause the clamp members to remain in the clamped position on the cymbal for a longer or shorter period of time to vary the dampening effect on the vibration and sound of the cymbal.

An important feature of the present invention is the structure of the second switching means comprising a contact switch preferably mounted on or associated with one of the clamping members and disposed in engageable relation with a portion of the cymbal as it travels along its normal path of displacement when struck by a drumstick or like conventional instrument. Accordingly, in operation, the manually actuatable switch of the first switch means is activated by the player of the cymbal. This serves to activate the positioning means and the reversible motor therein to bring the entire clamp assembly into the aforementioned operative position so that upon it being struck by a drumstick or the like it will be displaced into interruptive engagement and contact with the contacts which of the second switching means. Upon engagement of the cymbal with the contact switch of the second switching means, the activating means associated therewith will be operated so as to bring the clamped members into clamped engagement with opposite sides of the cymbal thereby holding it in a clamped position and rendering it immovable. An adjustable delay control switch is included to cause the clamped members to remain in the clamped position for a longer or shorter period of time to vary the dampening effect on the vibration and sound of the cymbal. As set forth above, this obviously will dampen any vibration of the cymbal and muffle any attendant sound issuing therefrom.

The clamp assembly may then be moved to its inoperative position allowing a normal playing of the cymbal and free movement thereof, without muffling or dampening by again operating the manual switch mechanism of the first switching means causing the reversible motor to operate in a reverse fashion and causing a withdrawal or displacement of the clamp assembly into the non-operative position.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in FIGS. 1 through 4, the present invention is directed towards a damper assembly generally indicated as 10 of the type used to dampen a cymbal structure generally indicated as 12 wherein the body of the cymbal as at 14 is typically of the type mounted on a conventional stand or like supporting member 16 and is operated or "played" by being repeatedly struck by a drumstick or an other like applicable and well-known instrument as at 18.

Figure 2:
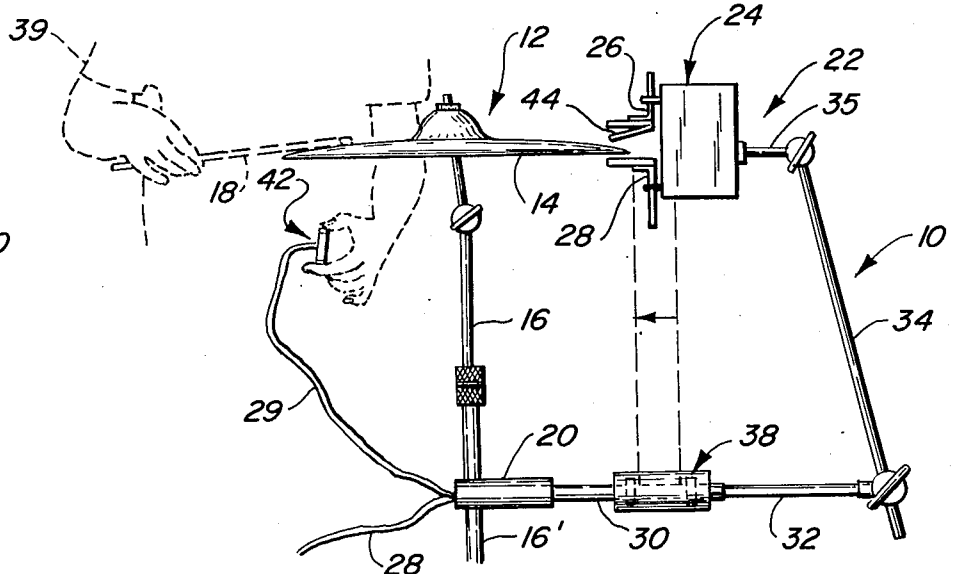
FIG. 2 is a schematic representation of the embodiment of FIG. 1 with a player represented in phantom line depicting a clamp assembly of the subject damper assembly of the present invention being moved into an operative position.
Figure 3:
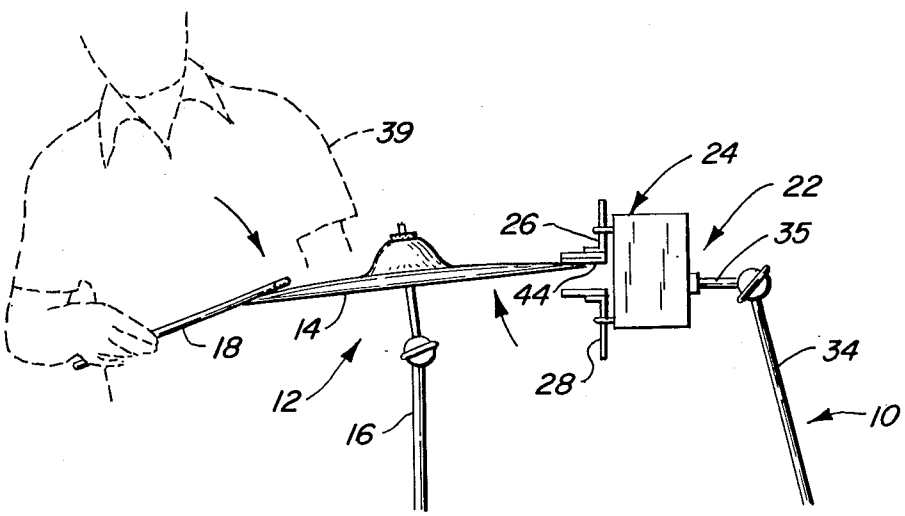
FIG. 3 is a schematic representation of the embodiments of FIGS. 1 and 2 in the next step of operation where a player is represented in phantom lines.
Figure 1:
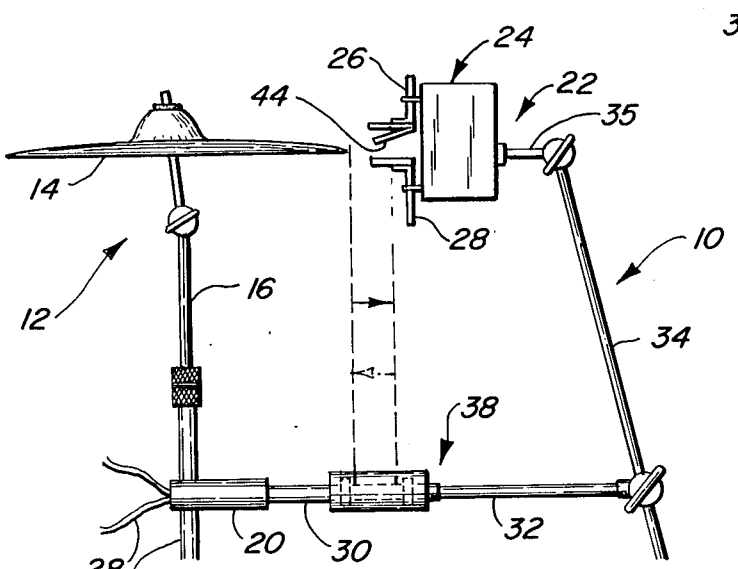
FIG. 1 is a schematic representation and partial cutaway of a cymbal and associated damper assembly shown in a non-operative position.
Figure 4:
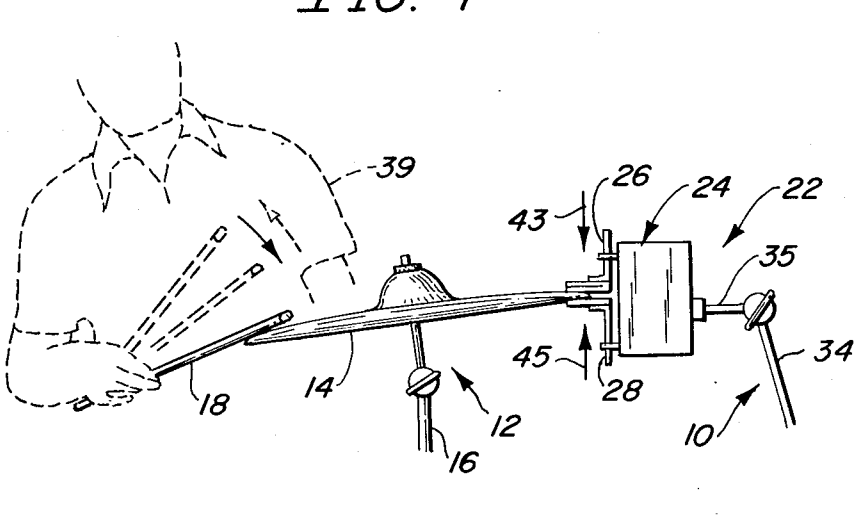
FIG. 4 is a schematic view in partial cut-away of the embodiments of FIGS. 1, 2 and 3 showing the next step of operation with a player represented in phantom lines therein.

The damper assembly 10 comprises a mounting means which may be any form of clamp or like supporting member attached to the positioning means represented by the casing 20 whether it be connected directly to the supporting rod or member for the cymbal structure 12 as at 16 or alternately whether it be a self-supporting independently mounted stand positioned on the floor or other supporting surface, A clamp assembly generally indicated as 22 includes an activating means of any number of conventional and well-known commercially available construction such as a electrically operable solenoid or the like in combination with an adjustable delay control switch, wherein the activating means is generally indicated and schematically represented as at 24. The activating means 24 includes two spaced-apart opposing clamp members 26 and 28 connected to the activating means 24 and upon operation or activation of the activating means serves to move at least one of the activating members towards the other such that the cymbal 14 or a portion thereof is effectively clamped between the clamp members 26 and 28 as clearly shown in FIG. 4. As set forth above, the activating means can in fact be an electrically operable solenoid mechanism (not shown for purposes of clarity) powered by a conventionally electric power source as from conductor 28 connected to a conventional wall outlet or the like. The conductor may travel through hollow linkage members 30, 32, 34 and 35 which may vary in size, configuration and number. The linkage members, as shown throughout the drawings provided herewith, serve to movably position and support the clamp assembly 22 in operative relation relative to the cymbal 14. In order to accomplish movement of the clamp assembly 22 between an operative position as shown in FIGS. 2, 3 and 4, and in inoperative position as shown in FIG. 1, the subject damper assembly 10 includes a positioning means generally indicated as 20. The positioning means may include a reversible motor of various construction electrically operable and interconnected to the electric power source by the conductor 28. Further, the positioning means 20 is connected to a first switching means 42 and disposed in the general vicinity of a player or operator of the assembly 39. While the first switching means 42 is represented as including a manually operatable switch mechanism as operated by the hand of the player 39, it can take a variety of other configurations so as to be operated by the foot, leg or other portions of the body. Alternately, a switch mechanism associated with the first switching means 42 may also be of the contact type such that it is activated to operate the positioning means 20 in a manner which will cause it to successively operate in a reverse direction. This contact mechanism, well-known in the art and commercially available, may be operated or activated by being struck with a drumstick 18 or like applicable instrument in the hand of the player 39. In any event, activation of the first switching means 42 connected to positioning means 20 by a secondary conductor 29 serves to operate the reversible motor, such that the linkage 32, 34 and 35 moves relative to the linkage means 38 and the positioning means at 20 so as to position the clamping means 22 into the operative position shown in FIG. 2. The limiting means 38 incorporates limiting switches which limit the movement of the linkage 32, 34 and 35 from an inoperative position as shown in FIG. 1 to an operative position as shown in FIG. 2. In such operative position the clamp members 26 and 28 are effectively spaced apart from opposite sides of a correspondingly position portion of the cymbal 14. In such position as clearly shown in FIGS. 2 and 3, striking of the cymbal 14 will cause its travel or displacement in the normal manner such that it will travel up into engagement with a contact switch mechanism 44 defining a portion of the second switching means associated with the clamp assembly 24. The contact switch mechanism 44 of the second switching means is electrically interconnected to the activating means 24 such that contact with a portion of the cymbal 14 upon it being struck with a drumstick 18 will cause it to activate the activating means 24 as shown in FIG. 3 causing the clamp members 26 and 28 to move relative to one another into concurrent engagement with opposite sides of a correspondingly positioned portion of the cymbal 14. Note directional arrows 43 and 45 in FIG. 4.

For purposes of clarity, the position of the clamp members 26 and 28 in both FIGS. 2 and 3 may define a non-clamping position of these clamps members. However, after contact occurs between a portion of the cymbal 14 and the contact switch mechanism 44 of the second switching means, the clamp members 26 and 28 will move into a clamped position as currently represented in FIG. 4.

In such a clamp position, the cymbal 14 or at least a portion thereof will be clamped securely between the clamp members 26 and 28 thereby rendering it immovable. This will of course have the effect of dampening any vibration normally occurring when the cymbal is struck and the further effect of muffling any attendant sound issuing from the cymbal 14. An adjustable timing control means is included in the activating means generally represented at 24 for clamped members 26 and 28 is included to cause the clamped members to remain in the clamped position for a longer or shorter period of time to vary the dampening effect on the vibration and sound of the cymbal 14.

Removal of the clamping assembly 22 back into its non-operative position as shown in FIG. 1 is readily accomplished by the manipulation of the switch mechanism 42 associated with the first switching means. This will have the effect of operating the reversible motor of the positioning means 20 in the opposite direction causing the clamp members 26 and 28 to be withdrawn from their clamped position as shown in FIG. 4. They will then immediately open since the contact switch member 44 of the second switching means will be brought to the position shown in FIGS. 1 and 2. This will serve to separate the clamp members 26 and 28 from one another since the contact switch member 44 of the second switching means will activate the activating means 24 to this position.

Now that the invention has been described, what is claimed is:

1. A damper assembly for a cymbal structure, said damper assembly comprising:

a. mounting means for positioning a remainder of the damper assembly in operative relation to the cymbal structure, b. an electrically operable clamp assembly connected to said mounting means and disposed adjacent the cymbal, c. positioning means being electrically operable and interconnected between said mounting means and said clamp assembly for selectively positioning said clamp assembly between an operative position and a non-operative position relative to the cymbal, d. an electric power source connected to both said clamp assembly and said positioning means, e. a first switch means electrically connected to said positioning means and disposed in accessible relation to a player of the cymbal and structured for direct, manual activation of said positioning means and placement of said clamp assembly between said operative and non-operative positions, f. a second switch means connected for automatic activation of said clamp assembly and mounted thereon in engageable, interruptive relation to the travel of the cymbal within its normal range of displacement when played, g. said operative position defined by disposition of said clamp assembly in grippable relation to the cymbal and disposition of said second switch means in interruptive relation to the travel of the cymbal, and h. said non-operative position defined by disposition of said clamp assembly and said second switch means out of engageable relation with said cymbal.

2. An assembly as in claim 1 wherein said clamp assembly comprises two opposing clamp members disposable between a clamping position and a non-clamping position relative to the cymbal when said clamping assembly is disposed in said operable position, said clamp members connected to an activating means, being a part of said clamp assembly for positioning said clamp members between said clamping position and said non-clamping position.

3. An assembly as in claim 2 wherein said clamping position is defined by concurrent engagement of each of said clamp members with a different opposite surface of said cymbal and the cymbal being disposed in clamped, dampened position therebetween.

4. An assembly as in claim 3 wherein said non-clamping position is defined by a spaced disposition of each of said clamp members with a different opposite surface of the cymbal and said second switch means disposed in engageable relation with a cymbal portion when the cymbal is normally displaced during playing and striking thereof.

5. An assembly as in claim 4 wherein said two clamp members are electrically connected to said activating means, said activating means being electrically powered by said power source and connected to said second switch means for activation thereof and for disposition of said two clamp members between said clamping and said non-clamping positions.

6. An assembly as in claim 5 wherein said second switch means comprises a contact switch member mounted on one of said clamp members and disposable in interruptive, contacting engagement by the cymbal during its displacement when being played, said contact switch member connected to said activating means for activation thereof and movement of said clamp member into and out of clamping position.

7. An assembly as in claim 5 wherein said activating means comprises a solenoid mechanism.

8. An assembly as in claim 2 wherein said second switch means is connected to said activating means for actuation thereof into said non-clamping position from said clamping position.

9. An assembly as in claim 2 wherein said second switch means comprises a contact switch member mounted on one of said clamp members and disposable in interruptive, contacting engagement by the cymbal during its displacement when being played, said contact switch means connected to said activating means for activation thereof and movement of said clamp member into said clamping position.

10. An assembly as in claim 1 wherein said first switch means is a manually operable switch mechanism disposed in the vicinity of the player and actuated by physical manipulation thereof.

11. An assembly as in claim 1 wherein said first switch means is a contact switch disposed in engageable disposition relative to the player and actuatable to operate said positioning means upon striking contact thereof by a drumstick.

12. An assembly as in claim 1 wherein said positioning means comprises a reversible drive motor means drivingly attached to linkage means for reverse direction travel thereof, said linkage means connected to said clamp assembly and moveable at least in part therewith for positioning said clamp assembly between said operative and said non-operative positions.

13. An assembly as in claim 12 further comprising a third switch means formed on said positioning means and comprising two limit switches electrically connected to said drive motor means for limiting travel of said linkage means in each of said opposite directions.

14. The assembly as set forth in claim 1 wherein adjustable timing control means are included in the second switch means to selectively control the time period of automatic activation of the clamp assembly to regulate the dampening effect of the assembly.

* * * * *